US011654534B2

(12) United States Patent
Snook et al.

(10) Patent No.: US 11,654,534 B2
(45) Date of Patent: May 23, 2023

(54) LOCKING MECHANISM AND CLOCKING CYLINDER

(71) Applicant: Wheelfloat, Inc., Southlake, TX (US)

(72) Inventors: Jonathan D. Snook, Southlake, TX (US); Thomas G. Fulbright, Keller, TX (US)

(73) Assignee: Wheelfloat, Inc., Southlake, TX (US)

( * ) Notice: Subject to any disclaimer, the term of this patent is extended or adjusted under 35 U.S.C. 154(b) by 189 days.

(21) Appl. No.: 17/114,163

(22) Filed: Dec. 7, 2020

(65) Prior Publication Data

US 2021/0170555 A1 Jun. 10, 2021

Related U.S. Application Data

(60) Provisional application No. 62/943,909, filed on Dec. 5, 2019.

(51) Int. Cl.

| | |
|---|---|
| ***B25B 23/00*** | (2006.01) |
| ***B25B 15/02*** | (2006.01) |
| ***B25G 1/08*** | (2006.01) |

(52) U.S. Cl.

CPC ..... *B25B 23/0035* (2013.01); *B25B 15/02* (2013.01); *B25G 1/085* (2013.01)

(58) Field of Classification Search

CPC ..... B25B 23/0035; B25B 15/02; B25G 1/085; B23B 31/107

See application file for complete search history.

(56) References Cited

U.S. PATENT DOCUMENTS

| | | | |
|---|---|---|---|
| 728,188 | A | 5/1903 | Barstad |
| 2,629,413 | A | 2/1953 | Stettler |
| 3,006,395 | A | 10/1961 | Dye |
| 3,750,729 | A | 8/1973 | Lemieux |
| 4,372,362 | A | 2/1983 | Ahn |
| 4,716,795 | A | 1/1988 | Corona et al. |
| 4,762,036 | A | 8/1988 | Orlitzky et al. |
| 5,325,745 | A | 7/1994 | Koehler |

(Continued)

FOREIGN PATENT DOCUMENTS

| | | | |
|---|---|---|---|
| CA | 2274503 | A1 | 12/2000 |
| CN | 102791435 | A | 11/2012 |

(Continued)

*Primary Examiner* — David B. Thomas

(74) *Attorney, Agent, or Firm* — Jack D. Stone, Jr., Esq.; Scheef & Stone, L.L.P.

(57) ABSTRACT

In a multi-bit screwdriver, a locking mechanism is formed from a tubular shaft having a passageway for facilitating travel of a selected bit through the passageway. A locking finger is formed longitudinally in the shaft and cantilevered from the shaft at a rearward end of the locking finger for facilitating radial spring action at a forward end of the locking finger. A locked detent and an unlocked detent are formed in the locking finger and are longitudinally spaced from each other, the locked detent being rearward of the unlocked detent. A track extends from the locked detent to the unlocked detent. A locking sleeve is slidably positioned on the shaft proximate the locking finger. A roller ball is mounted in the locking sleeve portion for engaging the locked detent or the unlocked detent, the roller ball being rollable along the track between the locked detent and the unlocked detent.

2 Claims, 6 Drawing Sheets

(56) References Cited

U.S. PATENT DOCUMENTS

| | | | |
|---|---|---|---|
| 5,337,637 | A | 8/1994 | Bih-Lien |
| 5,398,946 | A | 3/1995 | Quiring |
| 5,526,721 | A | 6/1996 | Waisvisz |
| 5,673,600 | A | 10/1997 | Yanagi et al. |
| 6,205,893 | B1 | 3/2001 | Sato |
| 6,332,384 | B1 | 12/2001 | Cluthe |
| 6,601,483 | B2 | 8/2003 | Wannop |
| 7,000,509 | B2 | 2/2006 | Shiao |
| 7,021,181 | B1 | 4/2006 | Chi |
| 7,028,593 | B1 | 4/2006 | Lin et al. |
| 7,665,391 | B2 | 2/2010 | Beauchamp |
| 7,757,589 | B2 | 7/2010 | Kielland |
| 8,783,138 | B2 | 7/2014 | Johnson |
| 10,076,835 | B2 | 9/2018 | Snook et al. |
| 10,442,074 | B2 | 10/2019 | Fulbright et al. |
| 2002/0096024 | A1 | 7/2002 | Pao-Hsi |
| 2005/0092144 | A1 | 5/2005 | Shiao |
| 2007/0251358 | A1 | 11/2007 | Grand et al. |
| 2008/0111323 | A1 | 5/2008 | Braunberger |
| 2016/0311092 | A1 * | 10/2016 | Fulbright ..... B25F 3/00 |
| 2019/0047134 | A1 | 2/2019 | Snook et al. |

FOREIGN PATENT DOCUMENTS

| | | | |
|---|---|---|---|
| CN | 205765859 | U | 12/2016 |
| DE | 9411520 | U1 | 11/1995 |
| EP | 0978356 | B1 | 9/2005 |
| EP | 1381494 | B1 | 5/2007 |

* cited by examiner

LOCKING MECHANISM AND CLOCKING CYLINDER

CROSS-REFERENCE TO RELATED APPLICATIONS

This application claims the benefit of U.S. Provisional Application No. 62/943,909, filed Dec. 5, 2019, which application is hereby incorporated herein by reference, in its entirety.

TECHNICAL FIELD

The invention relates generally to a multi-bit screwdriver, and more particularly, to a multi-bit screwdriver having a clocking cylinder to align a bit in a screwdriver shaft, and a locking mechanism for locking the bit in a shaft for use.

BACKGROUND

A screwdriver represents a particular case in point wherein a person may need a number of different types of screwdrivers to perform a task. This is particularly problematic, time consuming, and even dangerous, when such person is working on a ladder and must continually go up and down the ladder to fetch different screwdrivers. For such cases, screwdrivers are available which hold a number of different bits selectable by a user; such screwdrivers are referred to as multi-bit screwdrivers. There are, however, a number of drawbacks associated with "multi-bit" screwdrivers. The most common drawback is that such screwdrivers typically require two hands to change a bit, which can be dangerous when, for example, a user is standing atop a high ladder. Another common drawback is that the number of bits is very limited, such as six or even fewer bits. A still further drawback is that bits can be dropped or lost during handling.

These drawbacks have been largely overcome with multi-bit screwdrivers as depicted by U.S. Pat. No. 10,442,074 B2 issued on Oct. 15, 2019 (the '074 patent), and US Pat. Publ. No. 2019/0047134 published on Feb. 14, 2019 (the '134 publication), which patent and patent publication are incorporated herein by reference in their entirety. A drawback with the screwdrivers disclosed in the '074 patent and the '134 publication is that the shaft and locking mechanism are difficult to manufacture and therefore expensive to manufacture.

In view of the foregoing, there is a need for a multi-bit screwdriver that incorporates a shaft and locking mechanism that is simple and relatively inexpensive to manufacture.

SUMMARY

The present invention, accordingly, provides a multi-bit screwdriver that incorporates a shaft assembly with a clocking cylinder and a locking mechanism that is relatively simple and inexpensive to manufacture. Specifically, a multi-bit screwdriver is disclosed that includes a locking mechanism formed from a tubular shaft having a passageway for facilitating travel of a selected bit through the passageway. A locking finger is formed longitudinally in the tubular shaft and cantilevered from the shaft at a rearward end of the locking finger for facilitating radial spring action at a forward end of the locking finger. A locked detent and an unlocked detent are formed in the locking finger and are longitudinally spaced from each other, the locked detent being rearward of the unlocked detent. A track extends from the locked detent to the unlocked detent. A locking sleeve is slidably positioned on the tubular shaft proximate the locking finger. A roller ball is mounted in the locking sleeve portion for engaging one of the locked detent and the unlocked detent, the roller ball being rollable along the track between the locked detent and the unlocked detent. When the roller ball is in the locked detent, the locked finger is depressed into the passageway and urges against a bit to lock it in place. When the roller ball is moved to the unlocked detent, the locking finger is released from the passageway and the bit is allowed to travel back in the passageway to the handle where it is stored.

A clocking cylinder is disclosed which is preferably sized to fit between a tubular shaft and an opening in a storage device for receiving a bit. The clocking cylinder comprises a cylinder. Each of preferably six lands are formed in the shape of a triangle on an interior surface of the cylinder. Each of preferably six grooves are formed in the shape of a triangle on the interior surface of the cylinder. The lands and grooves alternate in a complementary fashion so that a six-sided bit passing from the handle will be turned as needed to pass through a hexagonal passageway of the tube.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
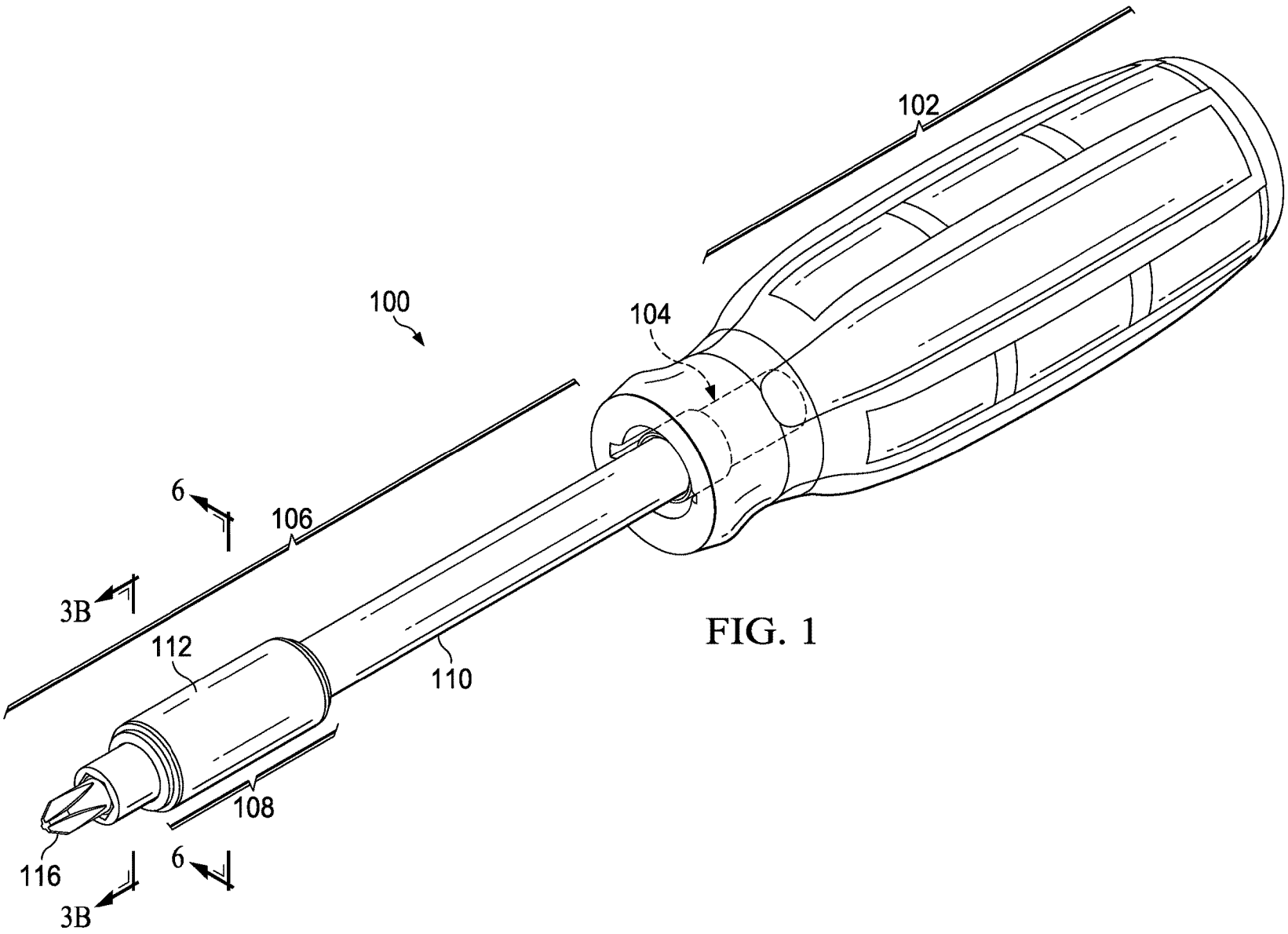
FIG. 1 is a perspective view of a multi-bit screwdriver embodying features of the present invention.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation. Refer now to the drawings wherein like or similar elements are designated by the same reference numeral through the several views.

Figure 6:
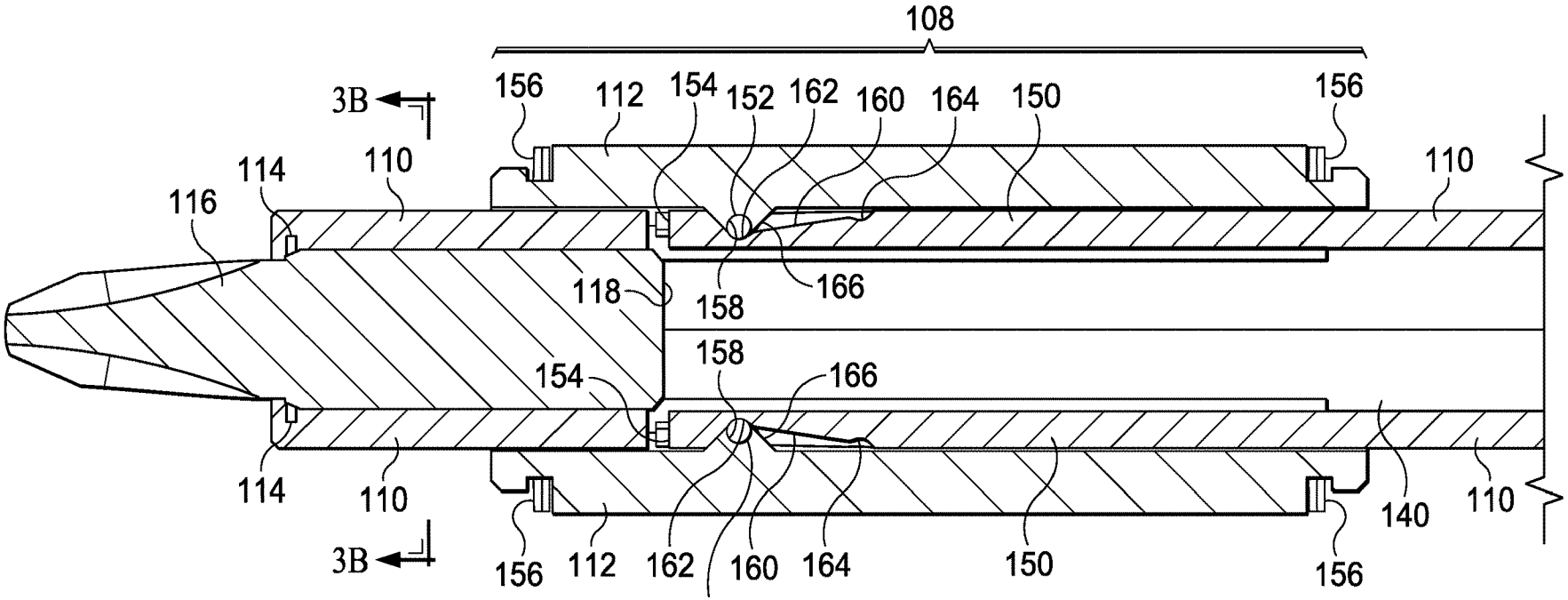
FIG. 6 is a cross-section of the screwdriver shaft assembly taken along line 6-6 of FIG. 1 in an unlocked configuration.
Figure 7:
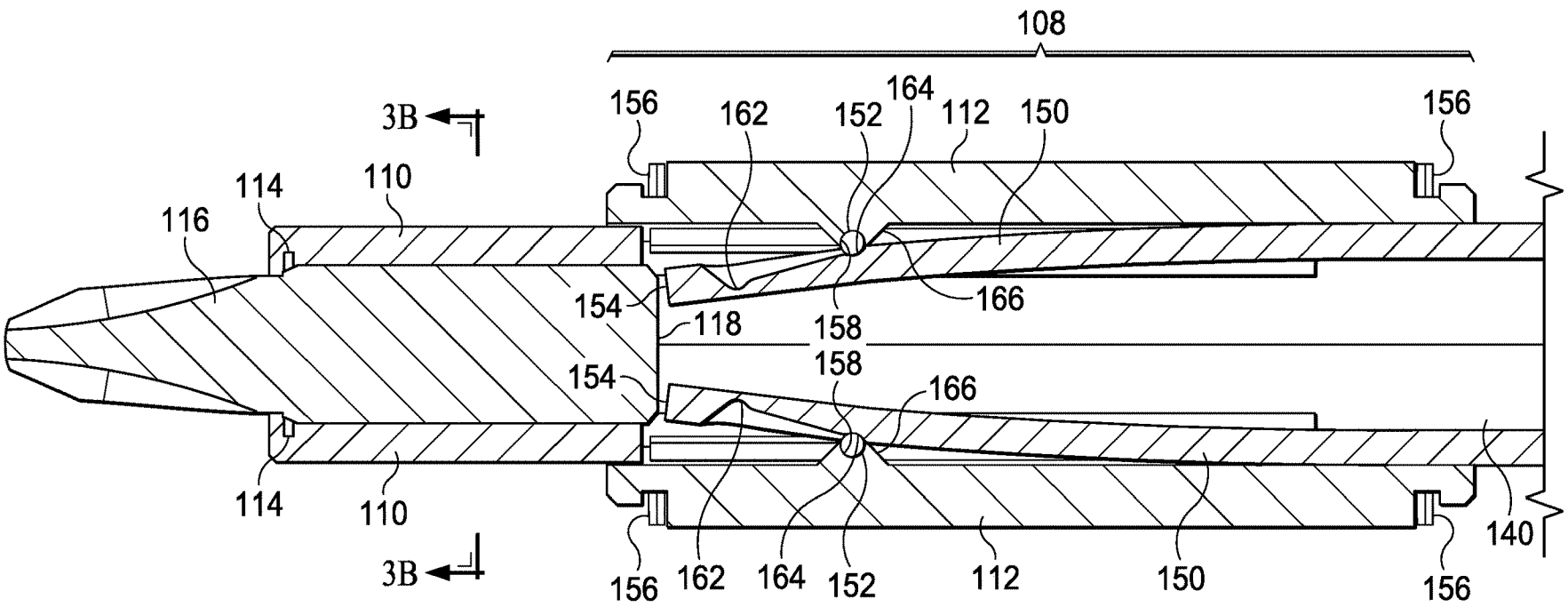
FIG. 7 is a cross-section of the screwdriver shaft assembly taken along line 6-6 of FIG. 1 in a locked configuration.

For purposes of definition, the term "bit" is used herein to signify any items desirable for storage, such as, by way of example, but not limitation, artist charcoal/pencils, children's crayons, drill bits, taps (for cutting threads), bobbins for sewing, spices, gauge pins, bits for a screwdriver, fishing weights, and the like. For purposes of illustration, bits will be depicted herein, by way of example, but not limitation, as a Phillips head bit in FIGS. 1, 6 and 7, representative of any of the foregoing items desirable for storage. Terms such as "forward" and "rearward" are relative terms as will be defined below with respect to respective drawings.

Referring to FIG. 1 of the drawings, the reference numeral 100 generally designates a multi-bit screwdriver embodying features of the invention for storing bits, as defined above. Screwdriver 100 includes a handle 102, a clocking cylinder 104, and a shaft assembly 106, at the end of which a bit 116 is secured. Handle 102 defines an opening (not shown) that opens into clocking cylinder 104 for communicating a bit between handle 102 and the clocking cylinder. Such a handle is exemplified as a storage device in the '074 patent and the '134 patent publication, and will not be described in further detail herein except insofar as necessary to describe the present invention. Shaft assembly 106 further includes locking mechanism 108, described in further detail below.

Figure 2:
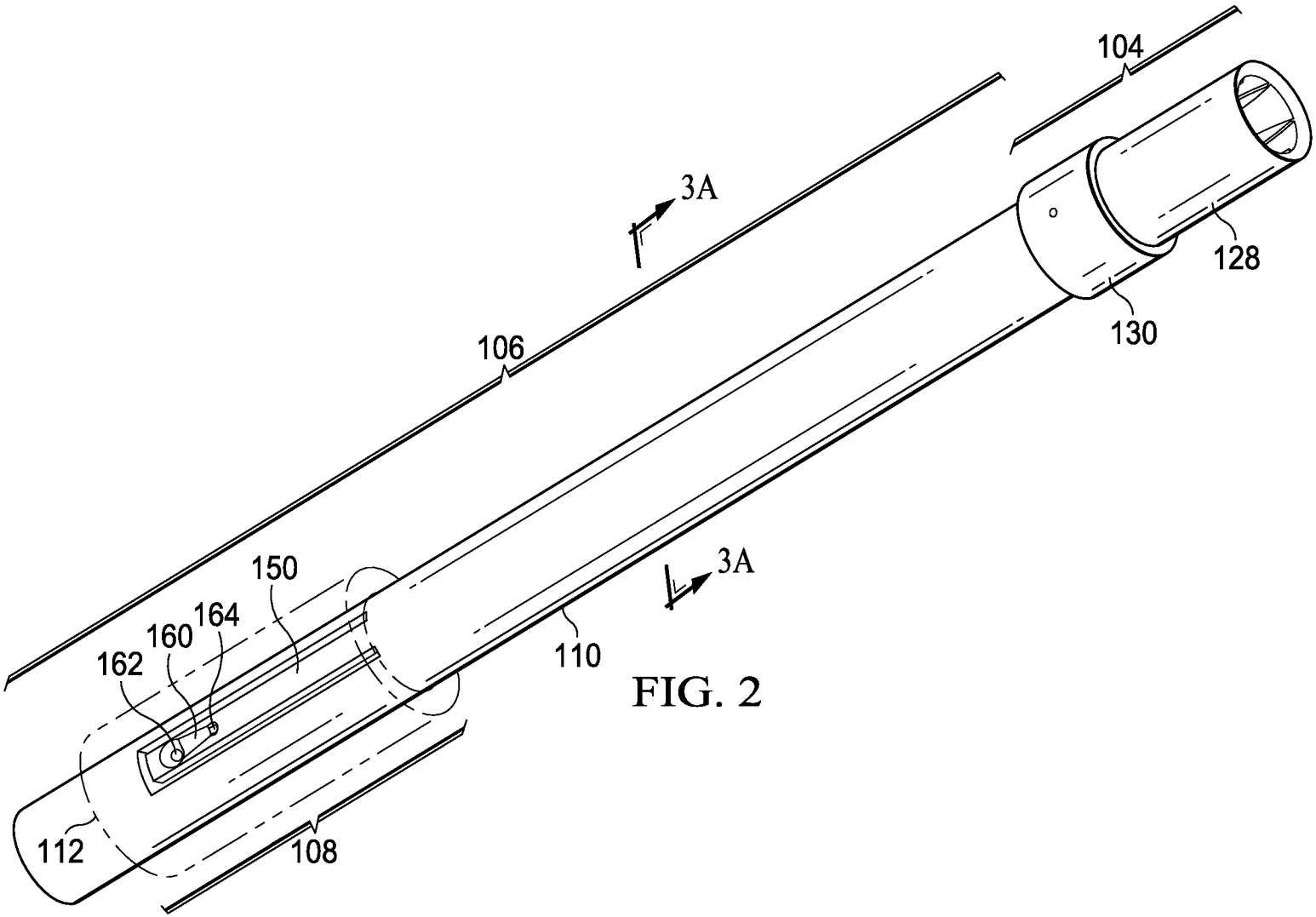
FIG. 2 is a perspective view of a shaft assembly of the screwdriver of FIG. 1.
Figure 3A:
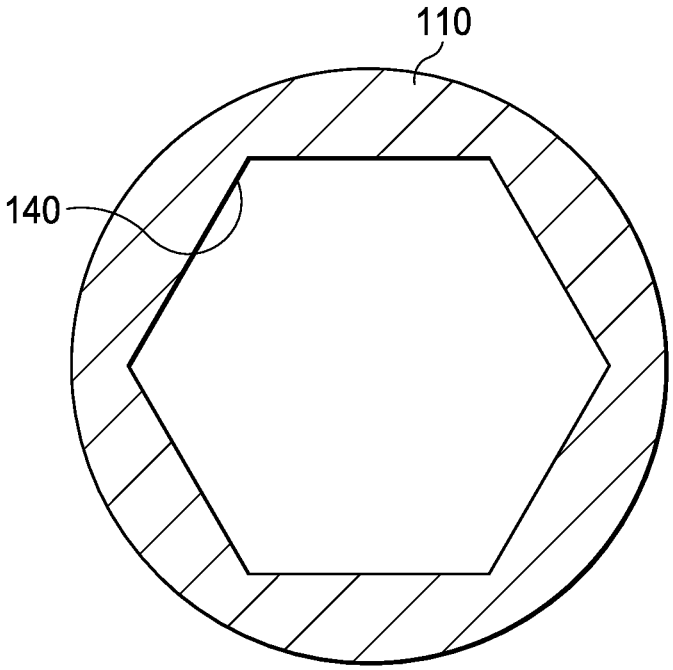
FIG. 3A is a cross-section of the tubular shaft of the screwdriver of FIG. 1, taken along line 3A-3A of FIG. 2.
Figure 4:
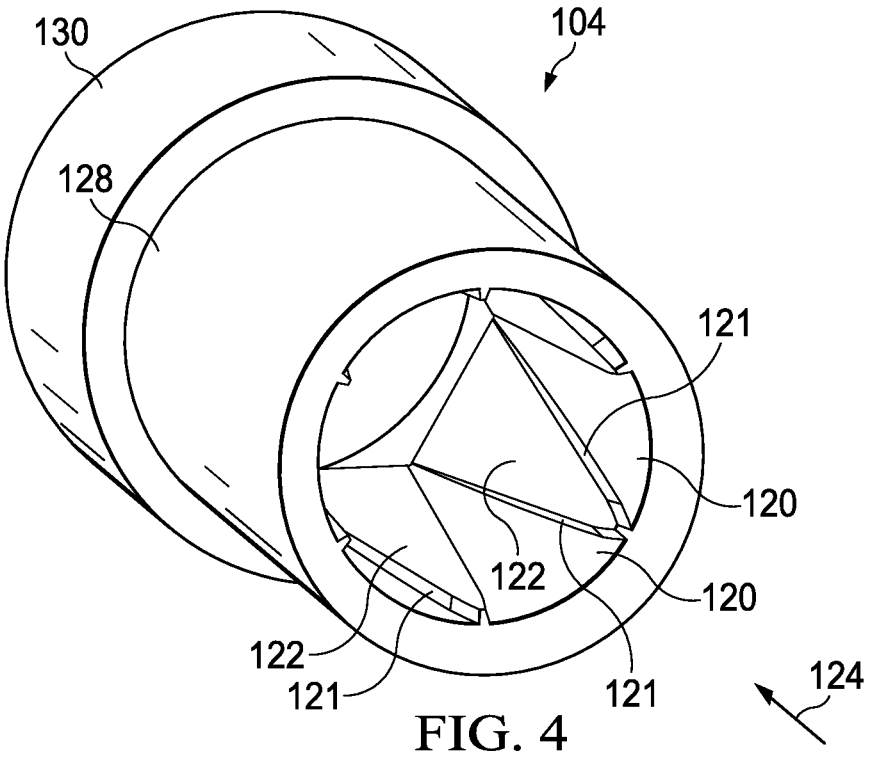
FIGS. 4 and 5 are perspective views of a clocking cylinder utilized in the screwdriver of FIG. 1.
Figure 5:
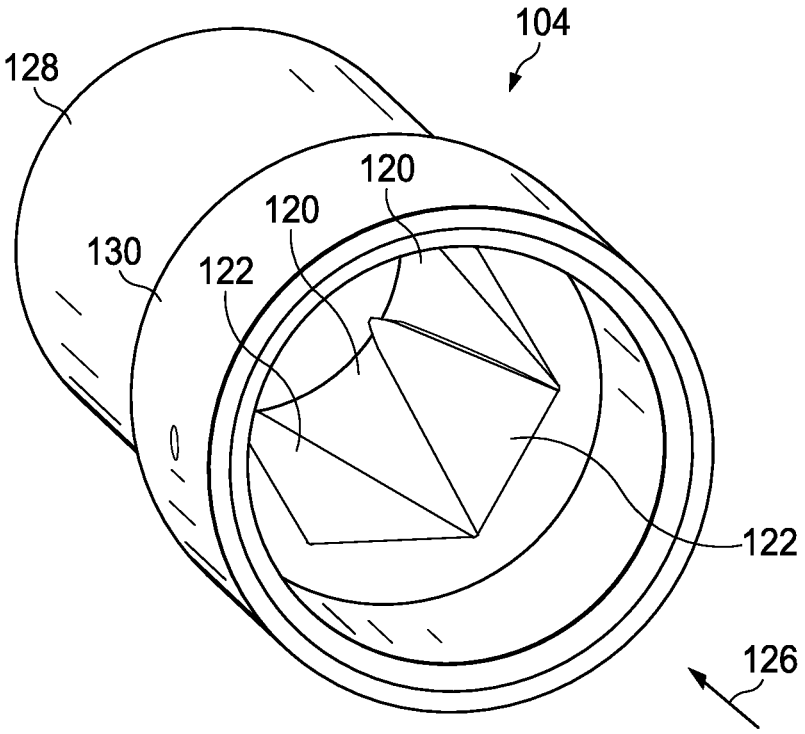

As shown in FIGS. 2, 4 and 5, clocking cylinder 104 is a cylinder preferably having a straight end 128 and a swaged end 130. Straight end 128 is configured to be securely joined within handle 102, and swaged end 130 is configured to be securely joined (e.g., press-fitted, tack-welded) to tubular shaft 110, so that a bit 116 may be communicated between handle 102 and tubular shaft 110, wherein tubular shaft 110 preferably defines an interior hexagonal passageway 140, as shown in FIG. 3A. Straight end 128 further includes an interior surface with substantially triangular-shaped grooves 120 and complementary substantially triangular-shaped lands 122 formed so that the base of each groove is interposed between the apex of two adjacent lands, and similarly, so that the base of each land is interposed between the apex of two adjacent grooves. The grooves 120 and lands 122 thus alternate in a complementary manner so that a six-sided bit 116 passing from the handle 102 to tubular shaft 110 will be turned as needed to align with and pass through hexagonal passageway 140 of shaft 110.

FIG. 2 depicts portions of locking mechanism 108. Accordingly, locking mechanism 108 preferably includes two locking fingers 150 (only one of which is shown in FIG. 2), spaced about 180° apart. Each locking finger 150 is configured as a cantilever extending longitudinally along shaft 110 from a rearward end (proximate cylinder 102) toward a forward end (distal from handle 102). Each of the two locking fingers 150 preferably defines an unlocked detent 162, a locked detent 164, and a track 160 extending from unlocked detent 162 to locked detent 164. Unlocked detent 162 is formed forward of locked detent 164, and runs deeper into a respective locking finger 150 than does locked detent 164.

FIGS. 6 and 7 depict locking mechanism 108 in greater detail. As discussed above, each locking finger 150 preferably includes an unlocked detent 162, a locked detent 164, and a track 160, the locking fingers being spaced about 180° apart. Locking sleeve 112 is preferably split longitudinally into two portions, each portion being configured to wrap over a respective locking finger 150. It can be appreciated that the two portions of locking sleeve 112 together form a cylinder that wraps around tubular shaft 110 proximate locking fingers 150, and are preferably secured in place via a retaining ring 156 positioned at each end of locking sleeve 112. Each portion of locking sleeve 112 preferably includes a protrusion 166 configured with a seat 158 into which a roller ball 152 is seated.

A stop 114 is positioned at the tip of tubular shaft 110 for preventing bit 116 from falling out of tubular shaft 110. Stop 114 comprises an element, such as a snap ring, a pin, a swage, or the like, effective for preventing bit 116 from falling out of tubular shaft 110.

Figure 3B:
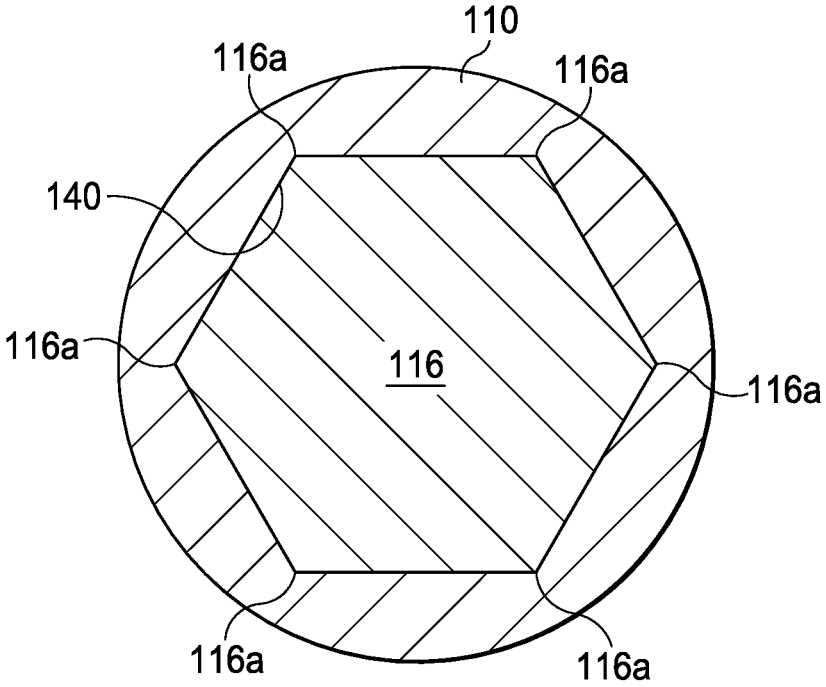
FIG. 3B is a cross-section of the tubular shaft of the screwdriver of FIG. 1, taken along line 3B-3B of FIGS. 1, 6, and 7.

In operation, a bit 116 is selected from handle 102 in a manner such as described in the '074 patent and/or the '134 patent publication. With reference to FIG. 4, bit 116 enters clocking cylinder 104 in the direction shown by arrow 124. As bit 116 passes through clocking cylinder 104, each of the hexagonal corners 116*a* (FIG. 3B) enters a groove 120 and engages a wall 121 which causes the bit to turn as necessary to enable the bit to pass through hexagonal passageway 140 as shown in FIG. 3B.

With locking sleeve 112 in a forward position as shown in FIG. 6, bit 116 then travels through locking mechanism 108. Locking sleeve 112 is then pulled rearward to cause roller ball 152 to roll along track 160 from unlocked detent 162 to locked detent 164, as shown in FIG. 7. As roller ball 152 seats in locked detent 164, each locking finger 150 is depressed into tubular shaft 110 passageway 140 as shown in FIG. 7 to cause forward edge 154 of locking finger 150 to urge against bit base 118 to thereby preclude bit 116 from traveling rearward toward handle 102. Multi-bit screwdriver 100 may then be used as a conventional screwdriver.

When it is desired to return bit 116 back to handle 102, locking sleeve 112 is moved forward to cause roller ball 152 to roll along track 160 from locked detent 164 (FIG. 7) to unlocked detent 162 (FIG. 6). As roller ball 152 seats in unlocked detent 162, each locking finger 150 is released from shaft passageway 140 as shown in FIG. 6, causing forward edge 154 of locking finger 150 to disengage from bit base 118 and allow bit 116 to travel rearward through clocking cylinder 104 in the direction of arrow 126 (see FIG. 5) toward handle 102 for storage therein.

It is understood that the present invention may take many forms and embodiments. Accordingly, several variations may be made in the foregoing without departing from the spirit or the scope of the invention. For example, the clocking cylinder may be positioned at the tip of the screwdriver, or the tip of the tubular shaft could have the requisite lands and grooves formed directly in it so a separate clocking cylinder would not be needed. In a further variation, the roller ball may be replaced with an extended protrusion 166 that is integral with the locking sleeve and simulates the shape and function of ball 152. Still further, there may be more or less than two locking fingers 150. The cross-sectional shape of bit 116 and passageway 140 as depicted in FIGS. 3A and 3B may be more or less than six-sided (hexagonal); e.g., it could have four or eight sides.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A locking mechanism for locking a bit at a forward end of a tubular shaft, the locking mechanism comprising:

a passageway defined within the tubular shaft for facilitating travel of the selected bit between a rearward end of the tubular shaft and a forward end of the tubular shaft opposing the forward end;

at least one locking finger formed longitudinally in the tubular shaft and cantilevered from the tubular shaft at a rearward end of the at least one locking finger for facilitating radial spring action at a forward end of the at least one locking finger;

at least one locked detent and at least one unlocked detent formed in the at least one locking finger and longitudinally spaced from each other, the at least one locked detent being rearward of the at least one unlocked detent;

a track extending between the at least one locked detent and the at least one unlocked detent;

a locking sleeve slidably positioned on the shaft proximate the at least one locking finger; and at least one roller ball mounted in the locking sleeve portion for engaging one of the at least one locked detent and the at least one unlocked detent, the at least one roller ball being rollable along the track between the at least one locked detent and the at least one unlocked detent.

2. The locking mechanism of claim 1, further comprising a handle coupled to a rearward end of the tubular shaft, the handle being configured for storing multiple bits transferable to the passageway of the tubular shaft, to thereby constitute a multi-bit screwdriver.

* * * * *